US011466424B2

(12) United States Patent
Beaudoin et al.

(10) Patent No.: US 11,466,424 B2
(45) Date of Patent: Oct. 11, 2022

(54) BRACKET FOR REVERSIBLY MOUNTING AN EXCAVATOR BUCKET ON AN ARTICULATED ARM

(71) Applicant: GROUP R.Y. BEAUDOIN INC., Victoriaville (CA)

(72) Inventors: Rémi Beaudoin, Victoriaville (CA); Alain Rivard, Victoriaville (CA); Luc D'Amours, Victoriaville (CA)

(73) Assignee: GROUP R.Y. BEAUDOIN INC., Victoriaville (CA)

( * ) Notice: Subject to any disclaimer, the term of this patent is extended or adjusted under 35 U.S.C. 154(b) by 837 days.

(21) Appl. No.: 16/153,006

(22) Filed: Oct. 5, 2018

(65) Prior Publication Data

US 2019/0106858 A1 Apr. 11, 2019

Related U.S. Application Data

(60) Provisional application No. 62/568,868, filed on Oct. 6, 2017.

(51) Int. Cl.
*E02F 3/36* (2006.01)

(52) U.S. Cl.
CPC ..... *E02F 3/3622* (2013.01); *E02F 3/364* (2013.01); *E02F 3/3686* (2013.01)

(58) Field of Classification Search
CPC ..... E02F 3/3622; E02F 3/3604; E02F 3/3686; E02F 3/364
USPC ..... 414/723
See application file for complete search history.

(56) References Cited

U.S. PATENT DOCUMENTS

| | | | | |
|---|---|---|---|---|
| 3,130,843 | A * | 4/1964 | Kelly | E02F 3/40 37/444 |
| 4,948,328 | A * | 8/1990 | Busch | E02F 3/3636 414/723 |
| 5,431,528 | A * | 7/1995 | Jenkins et al. | E02F 3/3631 172/275 |
| 5,611,158 | A * | 3/1997 | Pratt et al. | E02F 3/3613 172/272 |
| 7,014,385 | B2 * | 3/2006 | Lim et al. | E02F 3/3618 172/272 |
| 7,267,521 | B1 * | 9/2007 | Smith | E02F 3/3627 37/468 |
| 10,794,036 | B2 * | 10/2020 | Doyle | E02F 3/3609 |
| 2018/0002888 | A1 * | 1/2018 | Doyle | E02F 3/3609 |

* cited by examiner

*Primary Examiner* — Thomas B Will
*Assistant Examiner* — Joel F. Mitchell
(74) *Attorney, Agent, or Firm* — Benoit & Cote Inc.; Ibrahim Tamer

(57) ABSTRACT

A bracket for mounting an excavation bucket on a coupler of an articulated arm. The bracket comprises a body extending in a plane and having a central portion. A first concavity on a first side of the body substantially has an arc-of-circle shape to conform with a surface of a cylinder and hinge therearound. The bracket comprises a second concavity on a second side of the body opposite the first side with respect to the central portion. A third concavity on the second side of the body substantially has the arc-of-circle shape. The bracket comprises a first abutment edge formed by the central portion of the body; and a second abutment edge aside the first abutment edge and further from the central portion of the body compared to the first abutment edge. This bracket allows reversible mounting of the coupler of the excavation bucket.

17 Claims, 12 Drawing Sheets

BRACKET FOR REVERSIBLY MOUNTING AN EXCAVATOR BUCKET ON AN ARTICULATED ARM

CROSS-REFERENCE TO RELATED APPLICATIONS

This application claims benefit of U.S. patent application 62/568,868 filed Oct. 6, 2017, the specification of which is hereby incorporated herein by reference in its entirety.

BACKGROUND

(a) Field

The subject matter disclosed generally relates to construction vehicle equipment. More specifically, it relates to a bracket for an excavator bucket.

(b) Related Prior Art

Excavators are known for their articulated arm, extending from the vehicle, at the end of which a bucket is mounted. The bucket is normally mounted onto the articulated arm using a coupler to which a link of the articulated arm is attachable.

The bucket is oriented at the end of the articulated arm to perform various tasks, such as scraping material or transporting a load. The bracket and coupler mounted together are used in a given configuration which connects the bucket to the articulated arm in a single orientation.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

SUMMARY

Figure 1A:
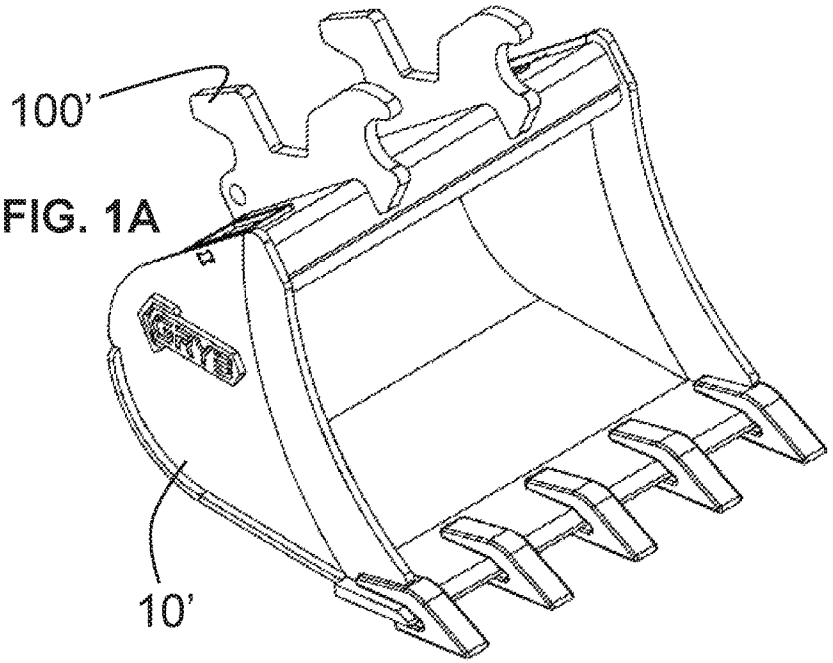
FIGS. 1A-1D are a perspective view, a top view, a front view and a side view, respectively, illustrating an excavator bucket including a mounting bracket, according to the prior art.
Figure 1C:
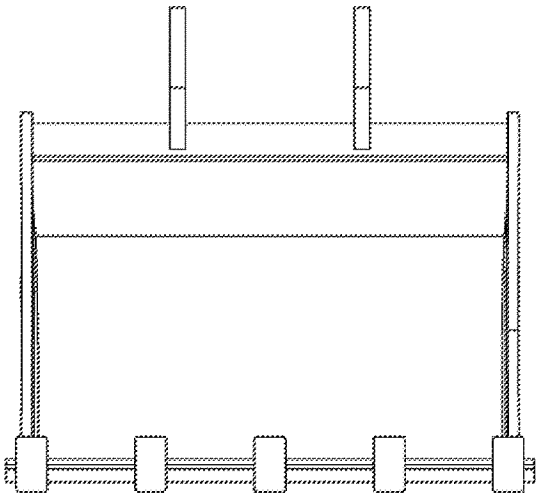
FIG. 1C PRIOR ART
Figure 1B:
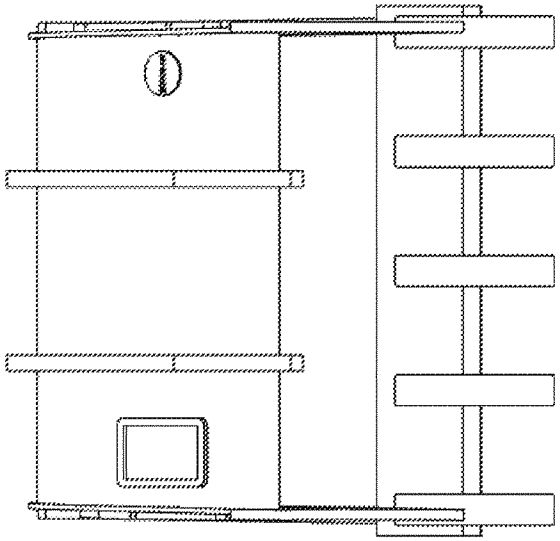
Figure 1D:
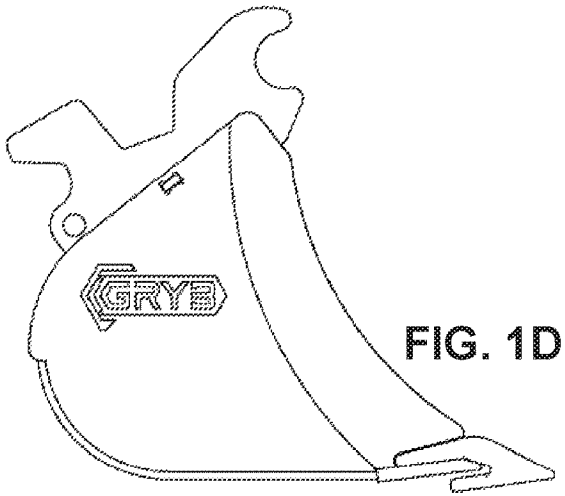

According to an aspect of the invention, there is provided a bracket for reversibly mounting an excavation bucket on a coupler of an articulated arm, the bracket comprising:

- a body extending in a plane and having a central portion;
- a first concavity located on a first side of the body with respect to the central portion, the first concavity substantially having an arc-of-circle shape to receive and conform with a surface of a hinge shaft of the coupler in a first one of two reversible configurations and hinge therearound;
- a second concavity on a second side of the body opposite the first side with respect to the central portion, for receiving a blocking bar of the coupler in the first one of two reversible configurations;
- a third concavity on the second side of the body, the third concavity substantially having the arc-of-circle shape for receiving the hinge shaft of the coupler in a second one of the two reversible configurations thus allowing reversible mounting on the coupler;
- a first abutment edge formed by the central portion of the body for receiving a stopper of the coupler in the first one of two reversible configurations; and
- a second abutment edge aside the first abutment edge and further from the central portion of the body compared to the first abutment edge, for receiving the stopper of the coupler in the second one of two reversible configurations.

According to an embodiment, the first concavity ends with a straight portion for receiving the blocking bar of the coupler in the second one of the two reversible configurations.

According to an embodiment, the third concavity is located above the second concavity on the second side of the body.

According to an embodiment, the first abutment edge and the second abutment edge formed by the central portion of the body are located between the first concavity and the third concavity.

According to an embodiment, the first abutment edge and the second abutment edge together form a two-stair shape on the body of the bracket to make the bracket adapted to receive the stopper of the coupler in any one of two reversible configurations.

According to an embodiment, the first concavity and the third concavity are each oriented to open outwardly from the central portion of the body.

According to an embodiment, the first concavity is oriented to open outwardly from the central portion of the body and the third concavity is oriented to open inwardly with respect to the central portion of the body.

According to another aspect of the invention, there is provided a bracket for mounting an excavation bucket on a coupler of an articulated arm, the bracket comprising:

a body extending in a plane and having a central portion;

a first concavity on a first side of the body with respect to the central portion, the first concavity substantially having an arc-of-circle shape to conform with a surface of a hinge shaft of the coupler in a first one of two reversible configurations and hinge therearound;

a second concavity on a second side of the body opposite the first side with respect to the central portion, for receiving a blocking bar of the coupler in the first one of two reversible configurations;

a third concavity on the second side of the body, the third concavity substantially having the arc-of-circle shape, for receiving the hinge shaft of the coupler in a second one of the two reversible configurations thus allowing reversible mounting on the coupler; and a fourth concavity on a first side of the body opposite the first side with respect to the central portion, for receiving a blocking bar of the coupler in the second one of two reversible configurations.

According to an embodiment, the body comprises a hollow central portion by the central portion of the body.

According to an embodiment, the fourth concavity is substantially the same shape as the second concavity, mirrored in the first side.

According to an embodiment, the second concavity is located above the third concavity.

According to an embodiment, the first concavity is located above the fourth concavity.

According to an embodiment, the hollow central portion is substantially symmetrical.

According to an embodiment, the hollow central portion comprises a recess and the recess is provided at a bottom thereof.

According to an embodiment, the hollow central portion comprises a first abutment edge and a second abutment edge on either sides of the recess provided at the bottom of the hollow central portion to make the bracket adapted to receive the a stopper coupler in any one of two reversible configurations and hold the stopper firmly by abutting on one of the first abutment edge and the second abutment edge and being confined at a corner of the stopper by the other one of the first abutment edge and the second abutment edge.

According to another aspect of the invention, there is provided a method for reversibly mounting an excavation bucket on a coupler of an articulated arm, the method comprising:

providing a bracket comprising a body extending in a plane and having a central portion;

in a first configuration of the coupler:

inserting a hinge shaft of the coupler in a first concavity on a first side of the body, the first concavity substantially having an arc-of-circle shape to conform with a surface of the hinge shaft and hinge therearound;

inserting a blocking bar of the coupler in a second concavity on a second side of the body opposite the first side with respect to the central portion;

abutting a stopper of the coupler by the central portion of the body of the bracket, and reversibly mounting the bracket and the coupler by:

removing the bracket from the coupler inserting the hinge shaft of the coupler in a third concavity on the second side of the body, the third concavity substantially having the arc-of-circle shape;

abutting the blocking bar of the coupler in a second concavity onto an edge of the first concavity;

reversibly abutting the stopper of the coupler by the central portion of the body of the bracket.

According to an embodiment, the first concavity and the third concavity are each oriented to open outwardly from the central portion of the body.

According to an embodiment, the first concavity is oriented to open outwardly from the central portion of the body and the third concavity is oriented

DETAILED DESCRIPTION

Figure 2A:
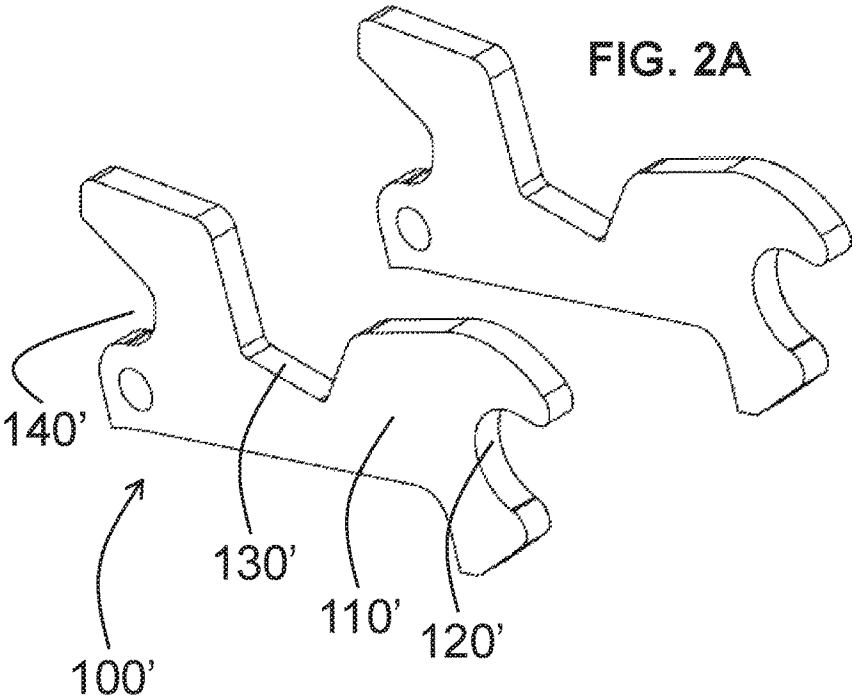
FIG. 2A PRIOR ART
FIGS. 2A-2B are a perspective view and a side view, respectively, illustrating a bracket for mounting an excavator bucket on an articulated arm, according to the prior art.
Figure 2B:
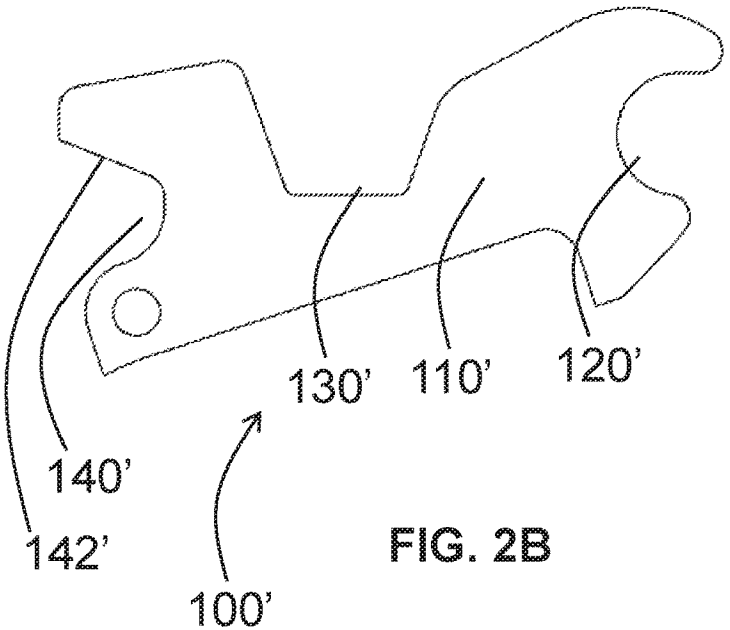

FIGS. 1A-1D illustrate a bucket 10' including a mounting bracket 100', according to the prior art. A typical excavation bucket 10' is shown is these figures. The mounting bracket 100', shown in FIGS. 2A-2B, is secured on top of the bucket 10'. As shown in FIGS. 3A-3D, the mounting bracket 100' is for cooperation with a dedicated coupler 20 on an articulated arm, such as an articulated arm found on a construction vehicle.

Figure 4A:
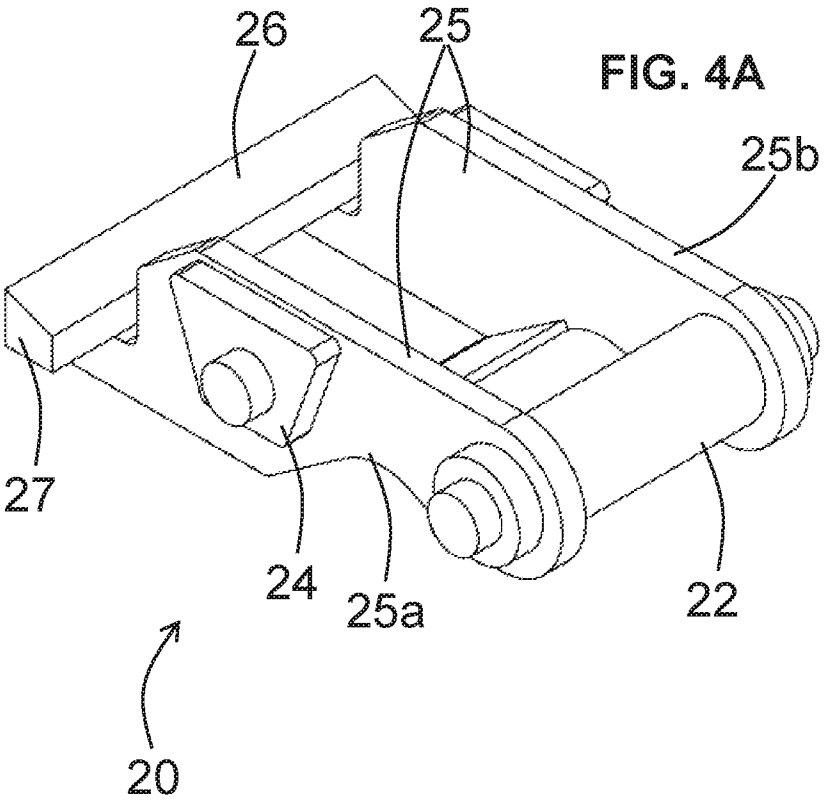
FIG. 4A PRIOR ART
FIGS. 4A-4C are a perspective view, a top view and a side view, respectively, illustrating the coupler of the articulated arm.
Figure 4B:
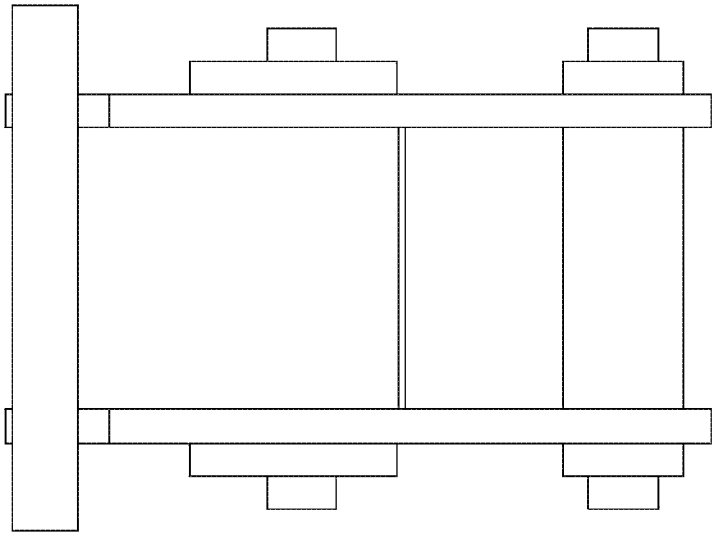
Figure 4C:
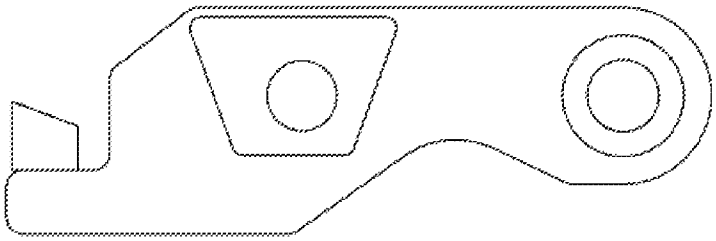
Figure 5A:
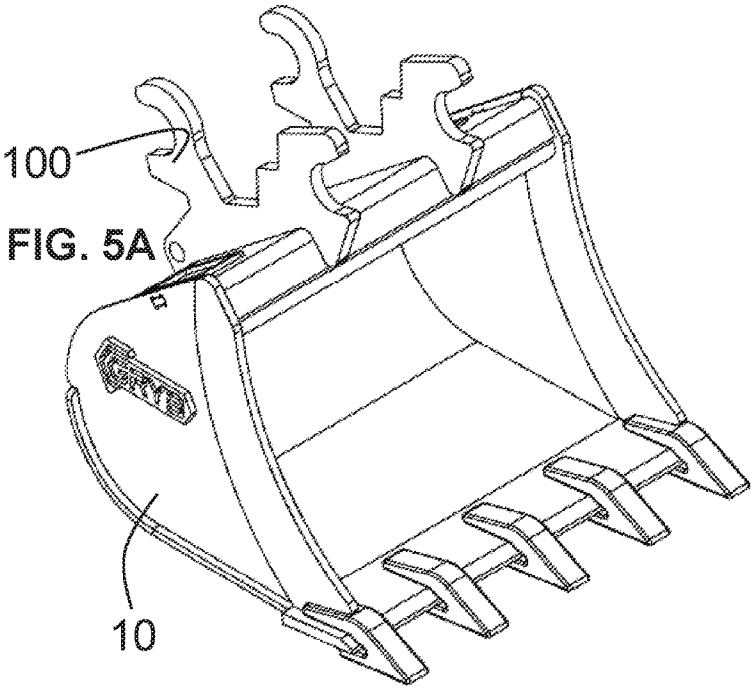
FIGS. 5A-5D are a perspective view, a top view, a front view and a side view, respectively, illustrating an excavator bucket including a mounting bracket, according to a first embodiment of the invention.
Figure 5B:
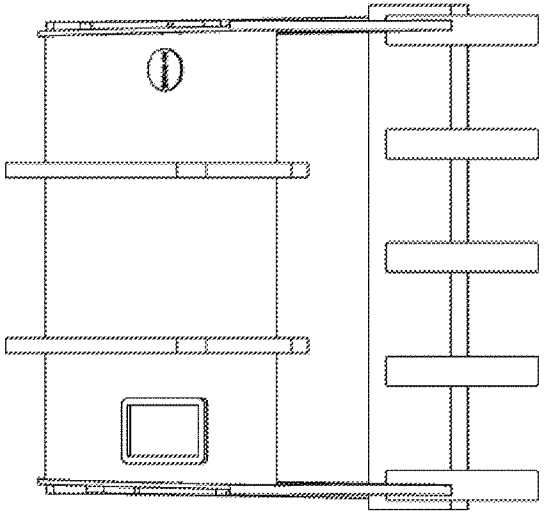
Figure 5C:
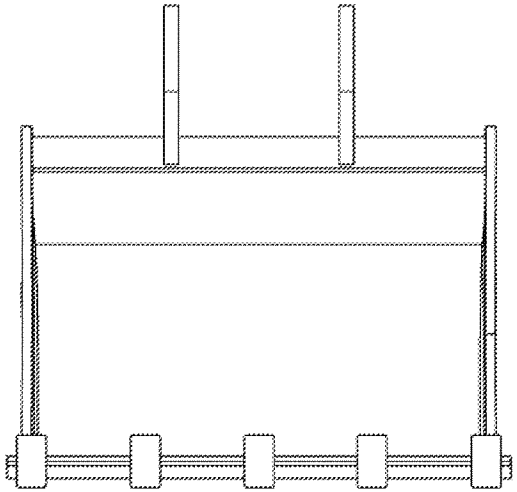
Figure 5D:
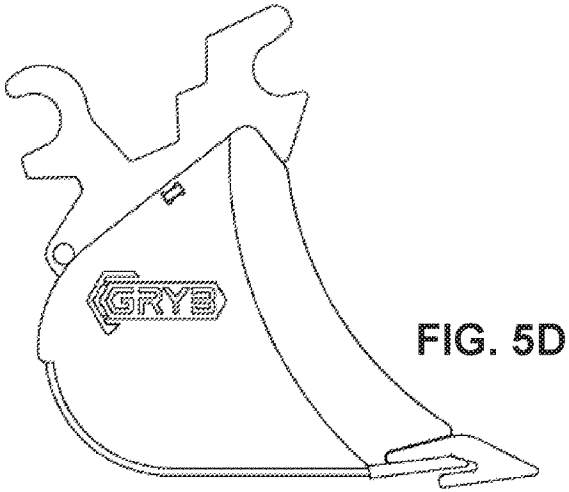

The coupler 20 is shown in FIGS. 4A-4C. The coupler 20 is standard and can be used with the bracket according to the prior art, or with the bucket according to the invention as described below. The coupler comprises a body 25 which may comprise a pair of parallel arms 25*a*, 25*b*, for example, as shown in FIG. 4A where the body is formed by two parallel elongated plates (i.e., arms 25*a*, 25*b*) forming each side of the body 25. Each of these side arms 25*a*, 25*b* comprises a stopper 24, each stopper 24 protruding outwardly on the sides of the coupler 20 (i.e., protruding toward the outside, from the side arms of the body 25) and providing a surface or edge for abutting onto a location on the bracket 100' and confine movement. The cross-section of the stopper 24 can have a rectangular or trapezoidal shape.

The body 25, with the pair of arms 25*a*, 25*b*, holds at one end of the arms a cylinder acting as a shaft, namely the hinge shaft 22, around which the bracket 100' can hinge. The hinge shaft 22 is cylindrical to provide rotatability around it. At a location opposite the hinge shaft 22 with respect to a central portion of the coupler 20 (i.e., at another end of the arms 25*a*, 25*b*), the coupler comprises a blocking bar 26 which extends parallel to the hinge shaft 22 and which contributes to securing the bracket to the coupler 20, along with the hinge shaft 22 and the stopper 24.

As shown in FIGS. 2A-2B, the prior art bracket 100', provided in pair, comprises a body 110' which extends in a plane and forms the solid base of one of the brackets 100' in the pair. The body 110' is shaped such as it comprises a first concavity 120' which is carved out from a side of the body in a concave fashion (i.e., toward a central portion of the body 110') and which an arc-of-circle shape conforms to a part of the cylindrical surface of the hinge shaft 22, which has a cylinder shape. This shape makes the first concavity 120' suitable to receive the hinge shaft 22 of the coupler 20 and thereby act as a hinge shaft receiver.

A second concavity 140' is carved out from the body 110' at a side thereof which is substantially opposite the first concavity 120' with respect to the central portion of the body 110'. The second concavity 140' is concave toward the central portion of the body 110'. It does not need to have an arc-of-circle or otherwise rounded shape. However, the second concavity 140' needs to conform with a portion of the surface of the blocking bar 26.

An abutment edge 130 is provided by the central portion, where the body narrows down and offers a substantially flat edge on which the stopper 24 of the coupler 20 can abut when the mounting bracket is mounted on the coupler 20.

The mounting bracket 100' is thus sandwiched between the hinge shaft 22, the blocking bar 26 and the stopper 24, and can securely hinge by the hinge shaft 22 to perform scraping, transportation and similar tasks. The bucket 10' of the prior art can be used to scrape material such as soil, sand, gravel, etc. However, the bucket 10' can only be installed on the articulated arm in a single orientation. This single standard orientation is provided by having the coupler 20 lock with the first concavity 120', the straight portion 142' of the second concavity 140', and the first abutment edge 130'.

The mounting bracket 100' according to the prior art and the coupler mounted together are used in a given configuration which connects the bucket to the articulated arm in a single orientation. There is now described below an embodiment which allows such a mounting to be reversible to allow two opposite configurations of the bucket on the articulated arm.

Now referring to FIGS. 5A-5D, there is shown a bucket 10 onto which there is secured a mounting bracket 100, according to an embodiment of the invention, which can be reversibly mounted on the coupler 20 to allow using the bucket 10 in two different orientations with respect to the articulated arm. This ensures that the bucket can be used in the most suitable orientation (e.g., upward or downward) for a given application. More particularly, as will be understood below, the mounting bracket can allow the bucket 10 to be mounted in a standard orientation, as discussion above in relation with the prior art, or in a reversed orientation. The first or standard orientation is provided by having the coupler 20 lock with the first concavity 120, the straight portion 142 of the second concavity 140, and the first abutment edge 130. The second or reversed orientation is provided by having the coupler 20 lock with the third concavity 150, the straight portion 122 of the first concavity 120, and the second abutment edge 135.

Figure 6A:
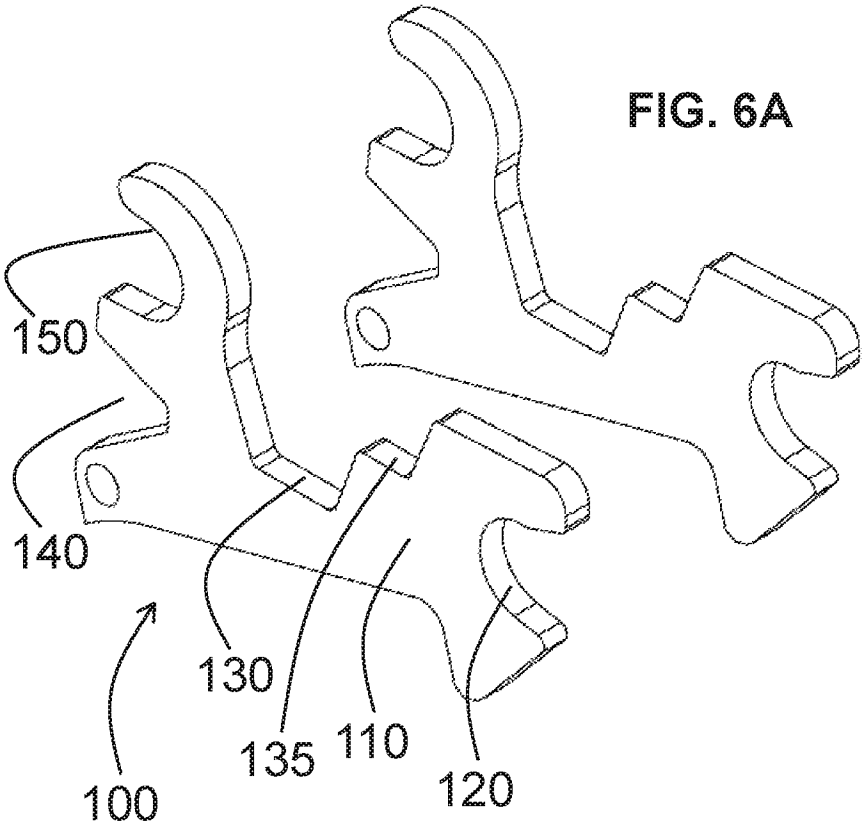
FIGS. 6A-6B are a perspective view and a side view, respectively, illustrating a bracket for mounting an excavator bucket on an articulated arm, according to the prior art.
Figure 6B:
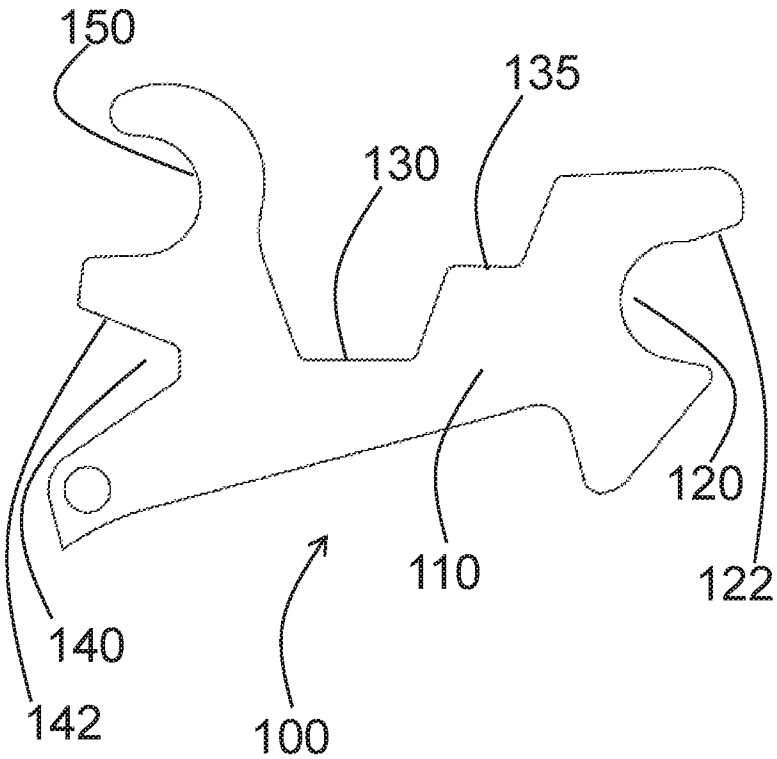

The mounting bracket 100 according to a first embodiment of the invention is shown in FIGS. 6A-6B. The mounting bracket 100 comprises all the features of the mounting bracket 100' of the prior art. Therefore, the bracket 100 comprises a body 110 which forms the solid base of the bracket 100. The body 110 is shaped such as it comprises a first concavity 120 which is carved out from a side of the body in a concave fashion (i.e., carved toward a central portion of the body 110 such that it forms an outward opening) and which has an arc-of-circle shape conforms to a part of the cylindrical surface of the hinge shaft 22, which has a cylinder shape. This shape makes the first concavity, having its opening directed outwardly, suitable to receive the hinge shaft 22 of the coupler 20 and thereby act as a hinge shaft receiver. Moreover, the first concavity 120 comprises a portion 122 that conforms with a portion of the surface of the blocking bar 26. According to an embodiment, the portion 122 that conforms with a portion of the surface of the blocking bar 26 is a straight portion within or at the edge of the portion otherwise shaped as an arc of circle. In the embodiment as shown in FIG. 6B, the arc-of-circle portion ends with the straight portion 122. This straight portion 122 can be at the upper edge of the portion shaped as an arc of circle, as shown in FIGS. 6A-6B where the arc of circle ends with, or is continued by, the straight portion. This straight portion has an angle that conforms with the surface of the blocking bar 26. Notably, it forms an angle that corresponds with an angle of the trapeze cross-section 27 of the blocking bar 26.

A second concavity 140 is carved out from the body 110 at a side thereof which is substantially opposite the first concavity 120 with respect to the central portion of the body 110. The second concavity 140 is concave toward the central portion of the body 110. It does not need to have an arc-of-circle or otherwise rounded shape. The second concavity 140 needs to grossly conform with a portion of the surface of the blocking bar 26. Moreover, the second concavity 140 comprises a portion 142 that conforms with a portion of the surface of the blocking bar 26. According to an embodiment, the portion 142 that conforms with a portion of the surface of the blocking bar 26 is a straight portion, similar to that of the first concavity 210, and as shown in FIGS. 6A-6B where the second concavity 140 comprises a straight portion 142. This straight portion has an angle that conforms with the surface of the blocking bar 26. Notably, it forms an angle that corresponds with an angle of the trapeze cross-section 27 of the blocking bar 26.

A first abutment edge 130 is provided by the central portion, where the body narrows down and offers a substantially flat edge on which the stopper 24 of the coupler 20 can abut when the mounting bracket is mounted on the coupler 20.

Figure 3A:
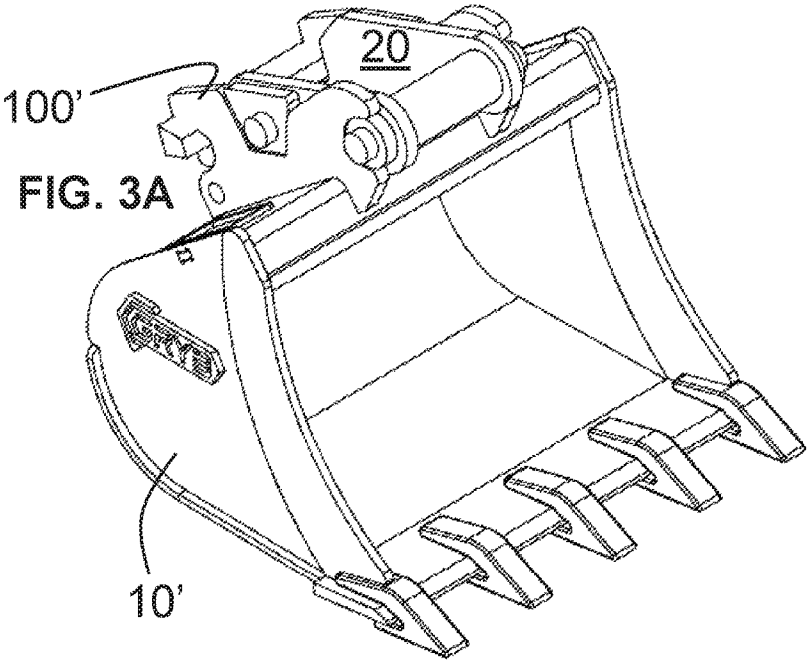
FIGS. 3A-3D are a perspective view, a top view, a front view and a side view, respectively, illustrating an excavator bucket including a bracket cooperatively mounted on the coupler of the articulated arm, according to the prior art.
Figure 3C:
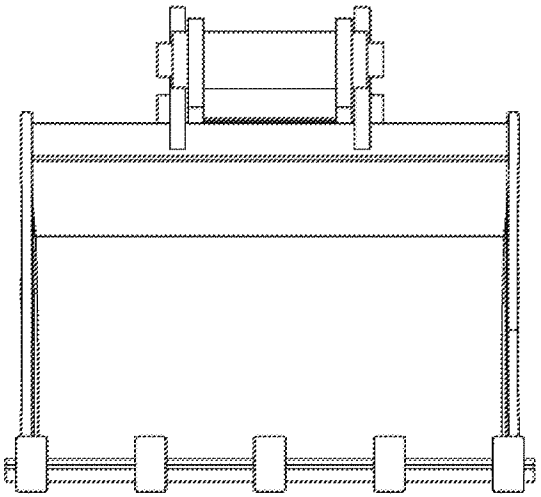
FIG. 3C PRIOR ART
Figure 3B:
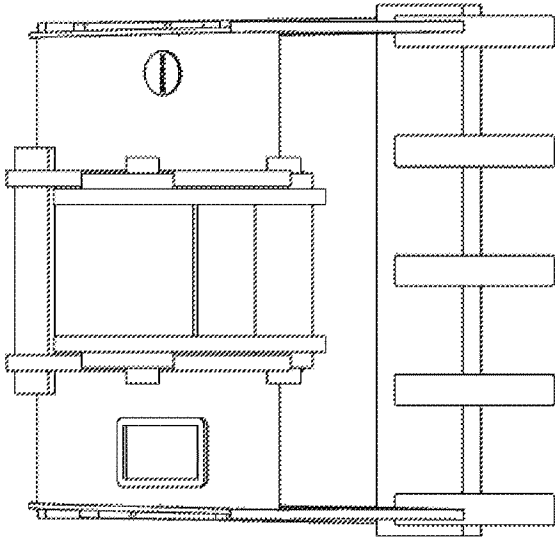
Figure 3D:
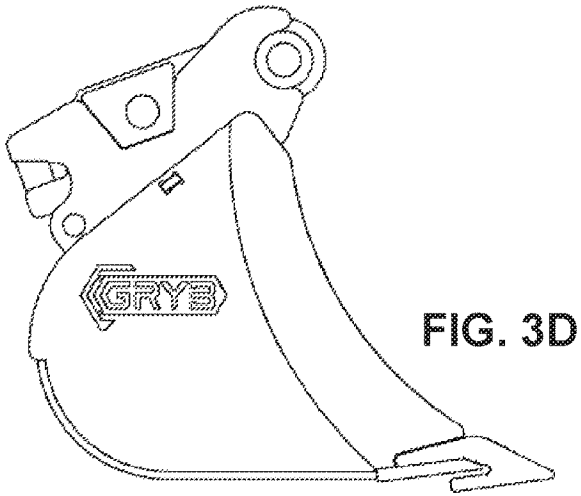
Figure 7A:
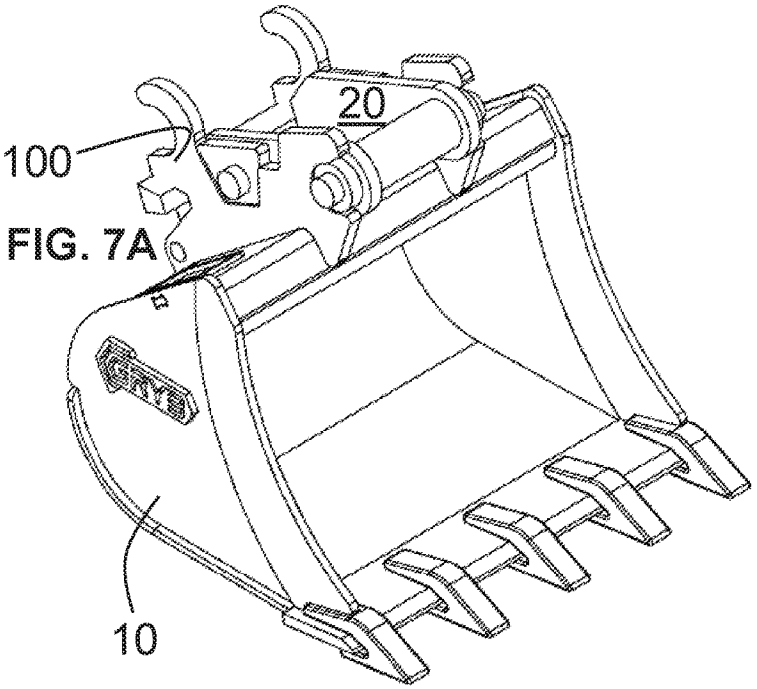
FIGS. 7A-7D are a perspective view, a top view, a front view and a side view, respectively, illustrating an excavator bucket including a mounting bracket cooperatively mounted on the coupler of the articulated arm, according to an embodiment, in the same orientation as in the prior art.
Figure 7C:
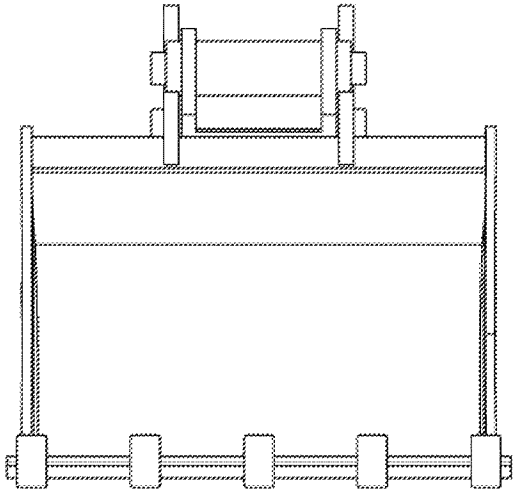
Figure 7B:
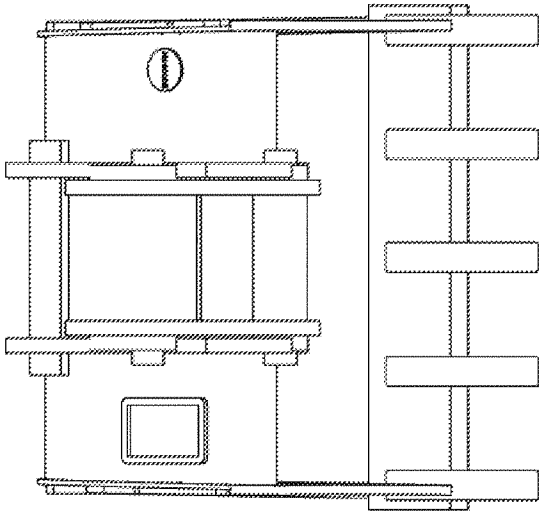
Figure 7D:
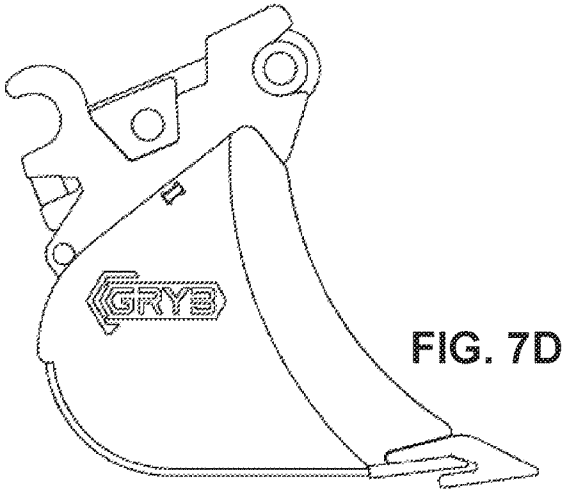
Figure 8A:
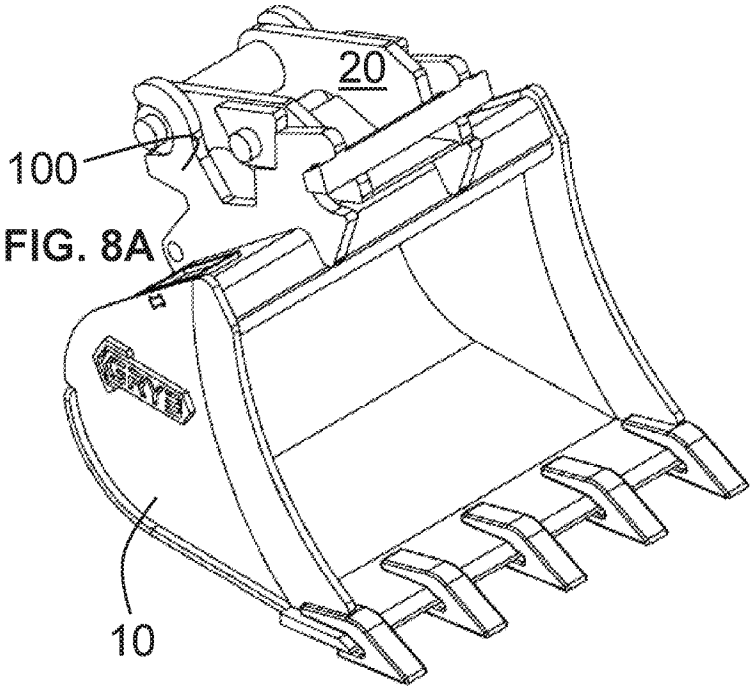
FIGS. 8A-8D are a perspective view, a top view, a front view and a side view, respectively, illustrating an excavator bucket including a mounting bracket cooperatively mounted on the coupler of the articulated arm, according to a first embodiment of the invention, in a reversed orientation compared to the prior art.
Figure 8C:
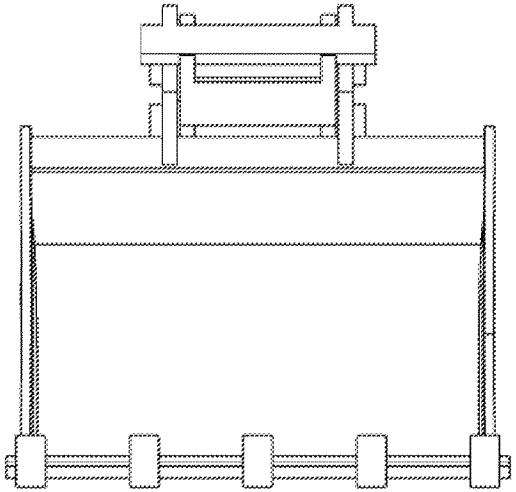
Figure 8B:
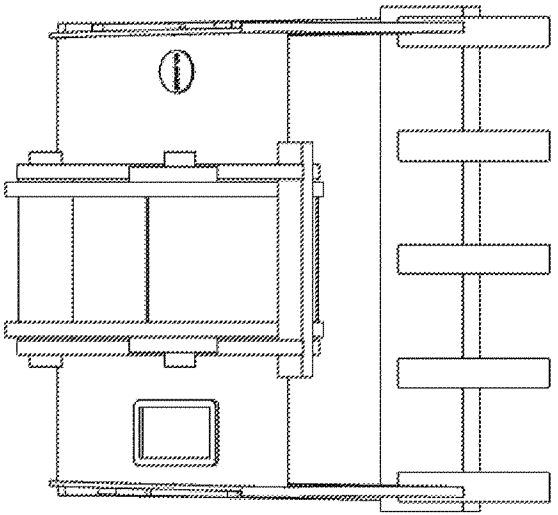
Figure 8D:
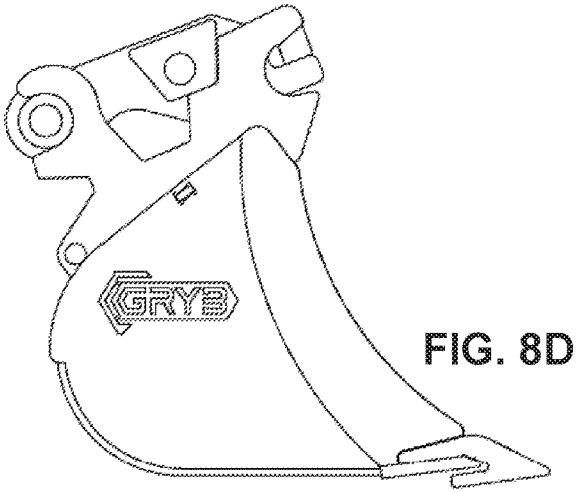

Moreover, and in addition to the prior art bracket 100', the bracket 100 comprises a second abutment edge 135. The second abutment edge 135 is shaped similarly as the first abutment edge 130 and is located at a position which is close to the first abutment edge 130. Both should be substantially parallel. The second abutment edge 135 is located at a different level compared to the first abutment edge 130, such as forming two steps. According to an embodiment, the second abutment edge 135 is located aside the first abutment edge 130 and further from the central portion of the body 110, thus forming the two-step stair. The second abutment edge 135 is suited to receive the stopper 24 of the coupler 20. More precisely, while the first abutment edge 130 is adapted to receive a first edge of the stopper 24, the second abutment edge 135 it adapted to receive a second edge of the stopper 24 which is located opposite the first edge of the stopper with respect to a central portion of the stopper 24. This two-stair shape on the body 110 of the bracket 100 makes the bracket 100 adapted to receive the coupler 20 in the standard orientation, as shown in FIGS. 3A and 7A, and further adapted to receive the coupler 20 in an orientation opposite the standard orientation, as shown in FIG. 8A.

Moreover, and in addition to the prior art bracket 100', the bracket 100 comprises a third concavity 150. The third concavity 150 should be of a shape substantially similar to the first concavity 120, or to the prior art first concavity 120' since the straight portion at an angle adapted for receiving the blocking bar 26 is not required for the third concavity 150. The third concavity 150 should be located approximately opposite the first concavity 120 with respect to the first concavity 120, and thus be located very close to the second concavity 140. According to an embodiment, the third concavity should be provided above the second concavity if the first abutment edge 130 and the second abutment edge 135 are also located above the central portion of the body 110, as shown in FIGS. 6A-6B.

By having a shape substantially similar to the first concavity 120, with an arc-of-circle shape conforms to a part of the cylindrical surface of the hinge shaft 22, the third concavity 150 can conform to a part of the cylindrical surface of the hinge shaft 22, which has a cylinder shape.

This shape makes the third concavity suitable to receive the hinge shaft 22 of the coupler 20 and thereby act as a hinge shaft receiver, as for the first concavity 120.

In addition to the second abutment edge 135 discussed above, this third concavity 150 makes the bracket 100 adapted to receive the coupler 20 in the standard orientation, as shown in FIGS. 3A and 7A, and further adapted to receive the coupler 20 in an orientation opposite the standard orientation, as shown in FIG. 8A.

The orientation opposite the standard orientation implies that the first concavity 120 receives the blocking bar 26, around which the bracket 100 does not hinge, contrarily to the hinge shaft 22. As discussed above, the first concavity 120 comprises a straight portion at an angle adapted for receiving the blocking bar 26.

This therefore makes the mounting bracket 100 adapted for reversible mounting orientation, in addition to the standard mounting orientation achieved in the prior art. Unlike the prior art bracket 100', for which only one standard orientation was possible with respect to the coupler 20 on the articulated arm, the mounting bracket 100 allows two different and opposite orientations as shown in FIGS. 7A and 8A. The first or standard orientation is provided by having the coupler 20 lock with the first concavity 120, the straight portion 142 of the second concavity 140, and the first abutment edge 130, which respectively cooperate with the hinge shaft 22, with the blocking bar 26, and with the stopper 24. The second or reversed orientation is provided by having the coupler 20 lock with the third concavity 150, the straight portion 122 of the first concavity 120, and the second abutment edge 135, which also respectively cooperate with the hinge shaft 22, with the blocking bar 26, and with the stopper 24. If a different orientation is required for scraping with the bucket or for a specific application using the bucket, the mounting bracket 100 can provide the required adaptability.

Figure 9B:
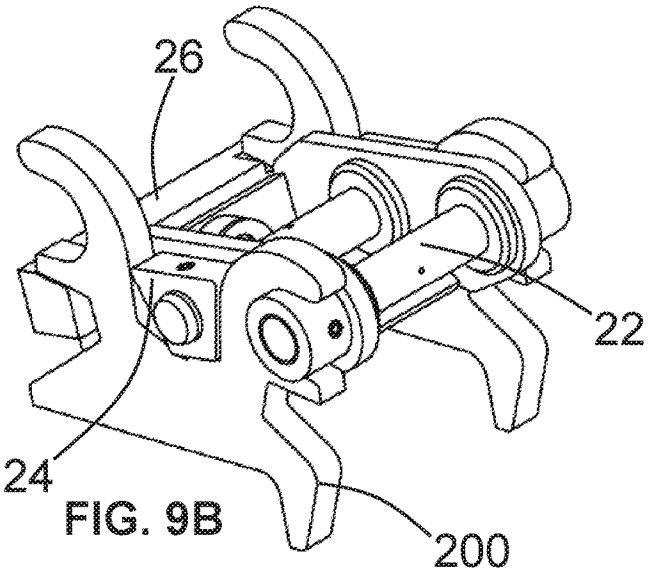
FIGS. 9A-9D are perspective views illustrating a mounting bracket cooperatively mounted on the coupler of the articulated arm, according to a second embodiment of the invention.
Figure 9D:
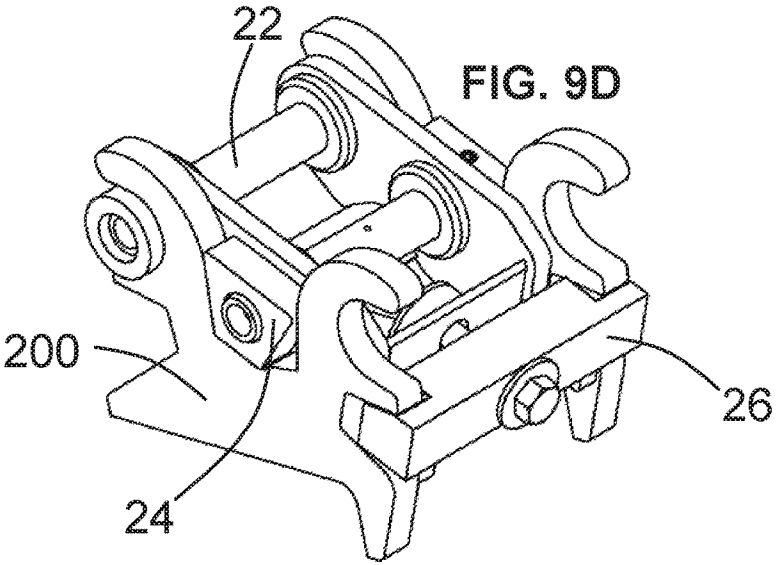
Figure 9A:
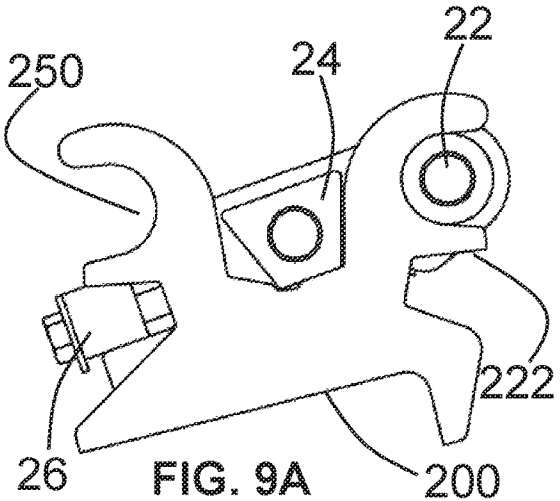
Figure 9C:
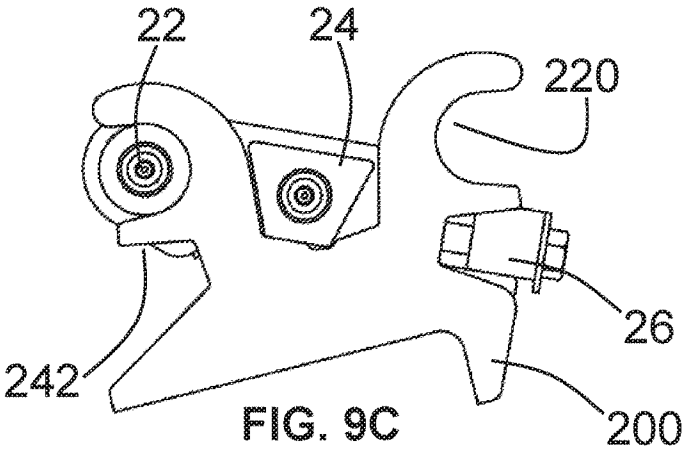
Figure 9F:
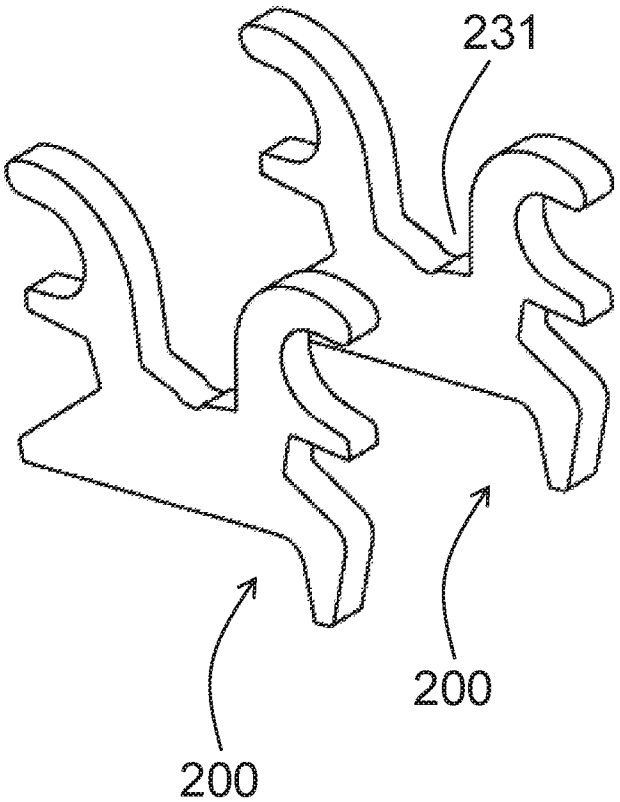
FIGS. 9E-9F are a perspective view and a side view of the mounting bracket of FIGS. 9A-9D.
Figure 9E:
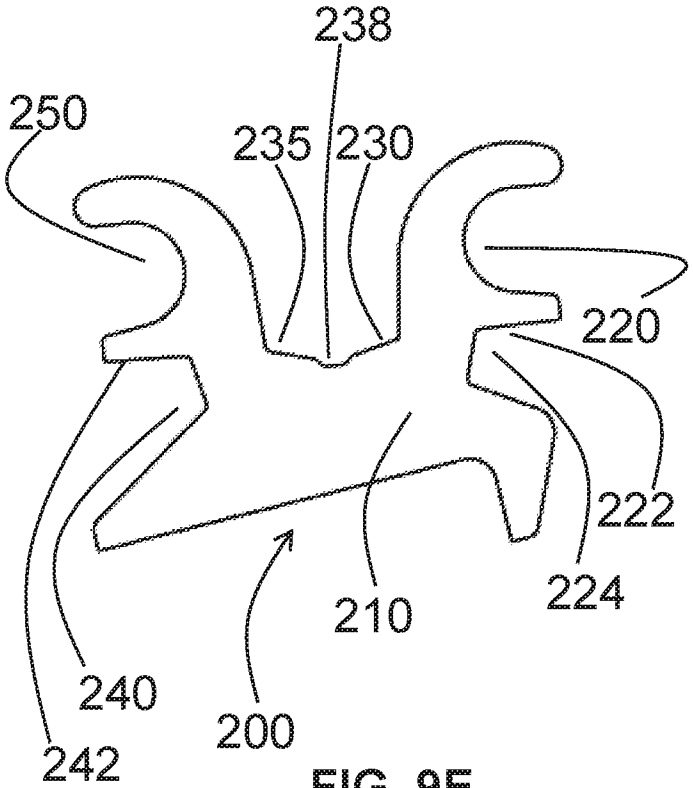

Now referring to FIGS. 9A-9F, there is shown another embodiment of a bracket 200. FIGS. 9A-9D show how the mounting bracket 200 can be arranged in two different positions with the coupler 20; FIG. 9E identifies clearly all parts of the mounting bracket 200, and FIG. 9F show that the mounting bracket 200 is normally provided in pair of parallel brackets.

The mounting bracket 200 comprises all the features of the mounting bracket 100' of the prior art. Therefore, the bracket 200 comprises a body 210 which forms the solid base of the bracket 100. The body 210 is shaped such as it comprises a first concavity 220 which is carved out from a side of the body in a concave fashion (i.e., carved toward a central portion of the body 210 such that it forms an outward opening) and which has an arc-of-circle shape conforms to a part of the cylindrical surface of the hinge shaft 22, which has a cylinder shape. This shape makes the first concavity, having its opening directed outwardly, suitable to receive the hinge shaft 22 of the coupler 20 and thereby act as a hinge shaft receiver.

Away from, the first concavity 220, the mounting bracket 200 comprises a fourth concavity 224 with a portion 222 that conforms with a portion of the surface of the blocking bar 26. The fourth concavity 224 does not need to have an arc-of-circle or otherwise rounded shape. The fourth concavity 224 needs to grossly conform with a portion of the surface of the blocking bar 26. According to an embodiment, the portion 222 that conforms with a portion of the surface of the blocking bar 26 is a straight portion within or at the edge of the fourth concavity 224. This straight portion has an angle that conforms with the surface of the blocking bar 26. Notably, it forms an angle that corresponds with an angle of the trapeze cross-section 27 of the blocking bar 26.

A second concavity 240 is carved out from the body 210 at a side thereof which is substantially opposite the first concavity 220 with respect to the central portion of the body 210. The second concavity 240 is concave, with the concavity directed toward the central portion of the body 210, and the opening thereof being thus directed outwardly. It does not need to have an arc-of-circle or otherwise rounded shape. The second concavity 240 needs to grossly conform with a portion of the surface of the blocking bar 26. Moreover, the second concavity 240 comprises a portion 242 that conforms with a portion of the surface of the blocking bar 26. According to an embodiment, the portion 242 that conforms with a portion of the surface of the blocking bar 26 is a straight portion, similar to the portion 222 of the fourth concavity 224, and as shown in FIG. 9E where the second concavity 240 comprises a straight portion 242. This straight portion has an angle that conforms with the surface of the blocking bar 26. Notably, it forms an angle that corresponds with an angle of the trapeze cross-section 27 of the blocking bar 26.

A first abutment edge 230 is provided by the central portion, where the body narrows down and offers a substantially flat edge on which the stopper 24 of the coupler 20 can abut when the mounting bracket is mounted on the coupler 20. The first abutment edge is provided in a hollow central portion 231 provided between the first and third concavities; this hollow central portion 231 is substantially symmetrical from a center thereof where a recess 238 is provided in the bottom of the hollow central portion 231. The hollow central portion 231 is for sticking the stopper 24 tightly thereinto, and holding it firmly in place, when the bracket 200 is mounted on the coupler 20 in any of the two orientations.

Moreover, and in addition to the prior art bracket 100', the bracket 200 comprises a second abutment edge 235. The second abutment edge 235 is shaped similarly as the first abutment edge 230 and is located at a position which is close to the first abutment edge 230, opposite the central portion of the body 210, where the small recess 238 is provided. Both abutment edges should be substantially provided symmetrically, in mirror, about the recess 238 which is centrally located between the concavities 220, 224 on one side, and the concavities 250, 240 on the other side. The second abutment edge 235 is located at an angle with respect to the longitudinal or horizontal axis of the mounting bracket 200, and the first abutment edge 230 is also provided with a similar angle but mirrored from the center of the body 210, such as forming two facing slopes with the small recess 238 in the middle. The second abutment edge 235 is suited to receive the stopper 24 of the coupler 20. More precisely, while the first abutment edge 230 is adapted to receive a first edge of the stopper 24, the second abutment edge 235 it adapted to receive a second edge of the stopper 24 which is located opposite the first edge of the stopper with respect to a central portion of the stopper 24 (i.e., the recess 238). The recess 238, or a portion close thereto, further receives another corner of the stopper 24 and thus aids in blocking the coupler 20 and the bracket 200 altogether. This facing dual-slope shape on the body 210 of the bracket 200 makes the bracket 200 adapted to receive the coupler 20 in the standard orientation, as shown in FIGS. 9A-9B, and further adapted to receive the coupler 20 in an orientation opposite the standard orientation, as shown in FIGS. 9C-9D.

Moreover, and in addition to the prior art bracket 100', the bracket 200 comprises a third concavity 250. The third concavity 250 should be of a shape substantially similar to the first concavity 220, since the straight portion at an angle adapted for receiving the blocking bar 26 is not required for the third concavity 250. The third concavity 250 should be located approximately opposite the first concavity 220 on the mounting bracket 200, and thus be located very close to the second concavity 240. According to an embodiment, the third concavity should be provided above the second concavity 240 if the first abutment edge 230 and the second abutment edge 235 are also located above the central portion of the body 210, as shown in FIG. 9E.

By having a shape substantially similar to the first concavity 220, with an arc-of-circle shape conforms to a part of the cylindrical surface of the hinge shaft 22, the third concavity 250 can conform to a part of the cylindrical surface of the hinge shaft 22, which has a cylinder shape. This shape makes the third concavity suitable to receive the hinge shaft 22 of the coupler 20 and thereby act as a hinge shaft receiver, as for the first concavity 220.

In addition to the second abutment edge 235 discussed above, this third concavity 250 makes the bracket 200 adapted to receive the coupler 20 in the standard orientation, as shown in FIGS. 9A-9B, and further adapted to receive the coupler 20 in an orientation opposite the standard orientation, as shown in FIGS. 9C-9D.

The orientation opposite the standard orientation implies that the first concavity 220 receives the blocking bar 26, around which the bracket 200 does not hinge, contrarily to the hinge shaft 22. As discussed above, the fourth concavity 224 comprises a straight portion 222 at an angle adapted for receiving the blocking bar 26.

This therefore makes the mounting bracket 200 adapted for reversible mounting orientation, in addition to the standard mounting orientation achieved in the prior art. Unlike the prior art bracket 100', for which only one standard orientation was possible with respect to the coupler 20 on the articulated arm, the mounting bracket 200 allows two different and opposite orientations as shown in FIGS. 9A-9B and 9C-9D. The first or standard orientation is provided by having the coupler 20 lock with the first concavity 220, the straight portion 242 of the second concavity 240, and the first abutment edge 230, which respectively cooperate with the hinge shaft 22, with the blocking bar 26, and with the stopper 24. The second or reversed orientation is provided by having the coupler 20 lock with the third concavity 250, the straight portion 222 of the first concavity 220, and the second abutment edge 235, which also respectively cooperate with the hinge shaft 22, with the blocking bar 26, and with the stopper 24. If a different orientation is required for scraping with the bucket or for a specific application using the bucket, the mounting bracket 200 can provide the required adaptability.

The embodiment of the mounting bracket 200 is further advantageous, in comparison with the first embodiment of the mounting bracket 100, in that when the stopper 24 generally abuts on the first abutment edge 230, it is further held in place by having another otherwise non-abutting corner thereof being stuck in place tightly by the second abutting edge 235. Similarly, when the stopper 24 generally abuts on the second abutment edge 235, it is further held in place tightly by having another otherwise non-abutting corner thereof being stuck in place by the first abutting edge 230. The mounting bracket 200 and the coupler 20 are therefore held in place particularly firmly, which is more secure overall.

Figure 10B:
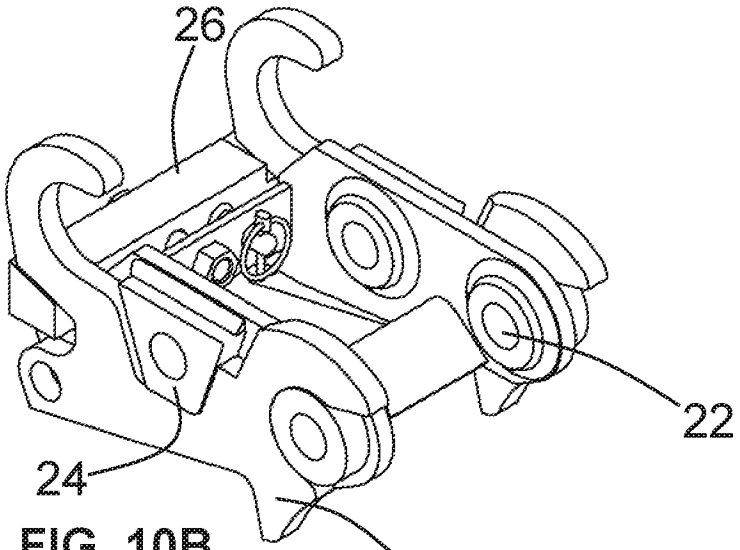
FIGS. 10A-10D are perspective views illustrating a mounting bracket cooperatively mounted on the coupler of the articulated arm, according to a third embodiment of the invention.
Figure 10D:
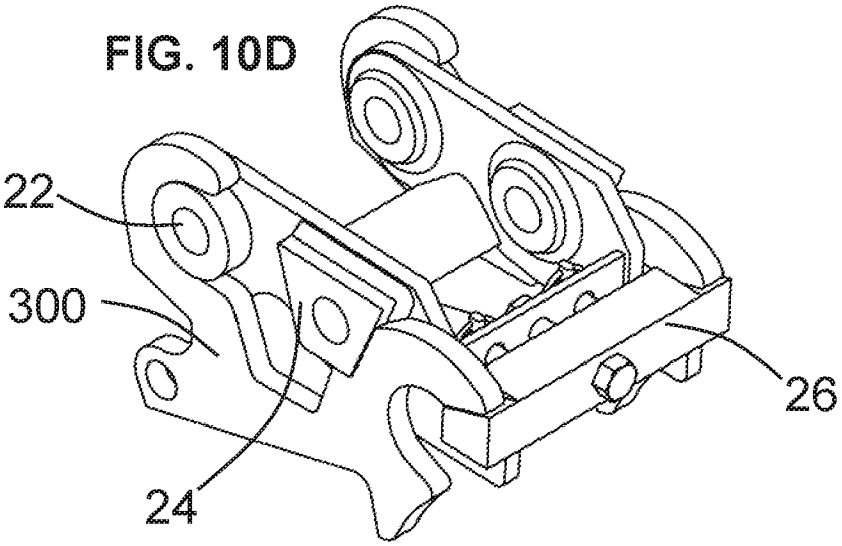
Figure 10A:
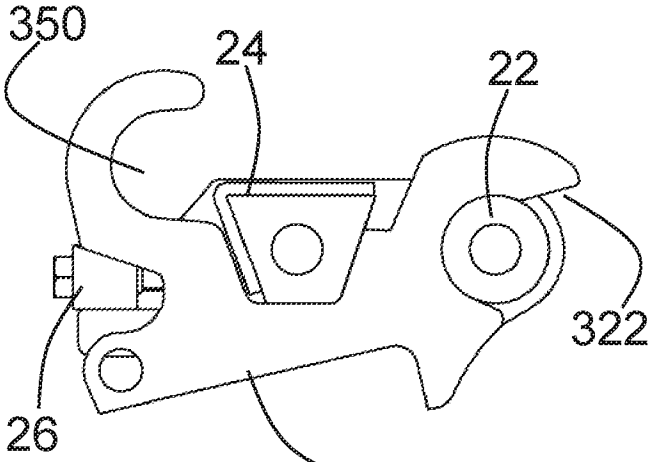
Figure 10C:
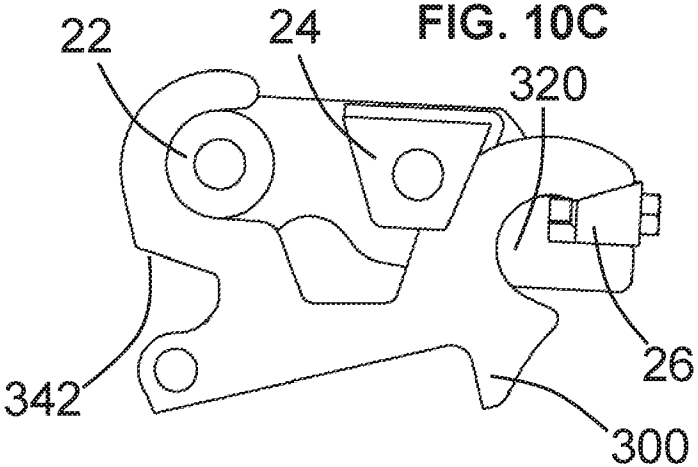
Figure 10F:
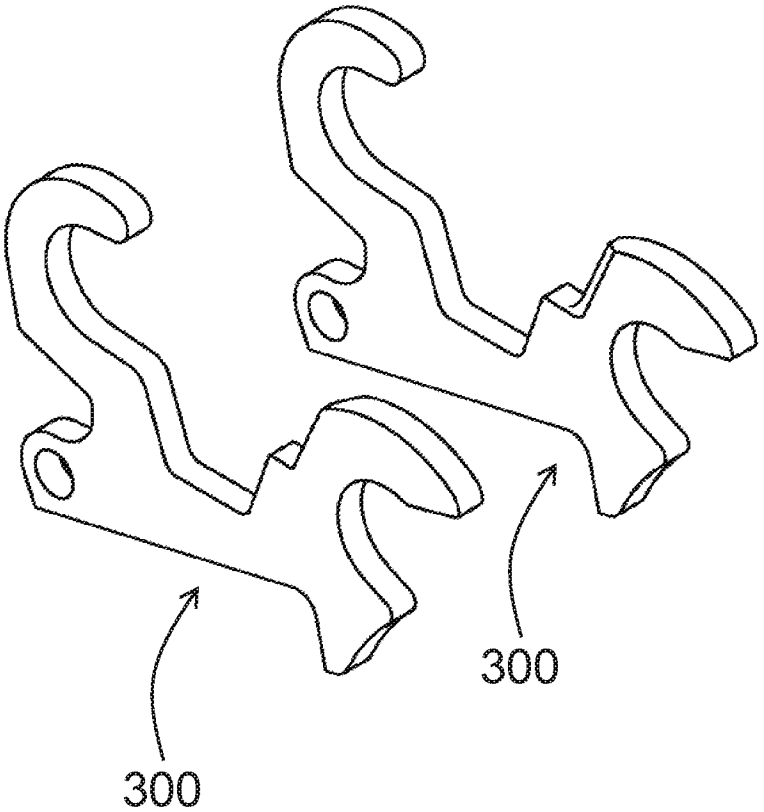
FIGS. 10E-10F are a perspective view and a side view of the mounting bracket of FIGS. 9A-9D.
Figure 10E:
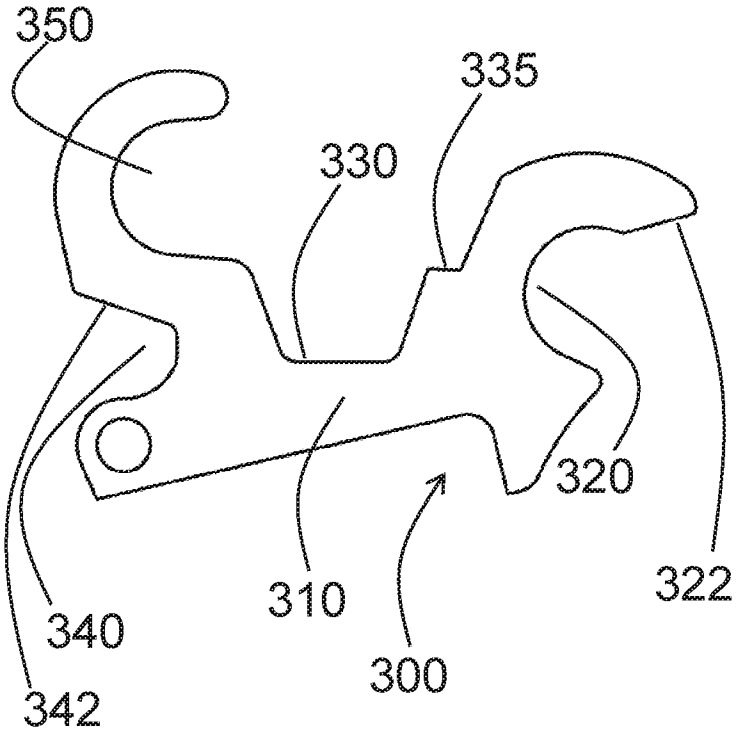

Now referring to FIGS. 10A-10F, there is shown another embodiment of a bracket 300. FIGS. 10A-10D show how the mounting bracket 300 can be arranged in two different positions with the coupler 20; FIG. 10E identifies clearly all parts of the mounting bracket 300, and FIG. 10F show that the mounting bracket 200 is normally provided in pair of parallel brackets.

The mounting bracket 300 is similar to the mounting bracket 100 described above. The bracket 300 comprises a body 310 which forms the solid base of the bracket 300. The body 310 is shaped such as it comprises a first concavity 320 which is carved out from a side of the body in a concave fashion (i.e., carved from the outside toward a central portion of the body 310 such that the first concavity 320 forms an opening that is directed outwardly) and which an arc-of-circle shape conforms to a part of the cylindrical surface of the hinge shaft 22, which has a cylinder shape. This shape makes the first concavity suitable to receive the hinge shaft 22 of the coupler 20 and thereby act as a hinge shaft receiver. Moreover, the first concavity 320 comprises a portion 322 that conforms with a portion of the surface of the blocking bar 26. According to an embodiment, the portion 322 that conforms with a portion of the surface of the blocking bar 26 is a straight portion within or at the edge of the portion otherwise shaped as an arc of circle, in the embodiment as shown in FIG. 10E, the arc-of-circle portion ends with the straight portion 322. This straight portion 322 can be at the upper edge of the portion shaped as an arc of circle, where the arc of circle ends with, or is continued by, the straight portion. This straight portion has an angle that conforms with the surface of the blocking bar 26. Notably, it forms an angle that corresponds with an angle of the trapeze cross-section 27 of the blocking bar 26.

A second concavity 340 is carved out from the body 310 at a side thereof which is substantially opposite the first concavity 320 with respect to the central portion of the body 310. The second concavity 340 is concave toward the central portion of the body 310. It does not need to have an arc-of-circle or otherwise rounded shape. The second concavity 340 needs to grossly conform with a portion of the surface of the blocking bar 26. Moreover, the second concavity 340 comprises a portion 342 that conforms with a portion of the surface of the blocking bar 26. According to an embodiment, the portion 342 that conforms with a portion of the surface of the blocking bar 26 is a straight portion, similar to that of the first concavity 310, and as shown in FIG. 10E where the second concavity 340 comprises a straight portion 342. This straight portion has an angle that conforms with the surface of the blocking bar 26. Notably, it forms an angle that corresponds with an angle of the trapeze cross-section 27 of the blocking bar 26.

A first abutment edge 330 is provided by the central portion, where the body narrows down and offers a substantially flat edge on which the stopper 24 of the coupler 20 can abut when the mounting bracket is mounted on the coupler 20.

Moreover, and in addition to the prior art bracket 100', the bracket 300 comprises a second abutment edge 335. The second abutment edge 335 is shaped similarly as the first abutment edge 330 and is located at a position which is close to the first abutment edge 330. Both should be substantially parallel. The second abutment edge 335 is located at a different level compared to the first abutment edge 330, such as forming two steps. According to an embodiment, the second abutment edge 335 is located aside the first abutment edge 330 and further from the central portion of the body 310, thus forming the two-step stair. The second abutment edge 335 is suited to receive the stopper 24 of the coupler 20. More precisely, while the first abutment edge 330 is adapted to receive a first edge of the stopper 24, the second abutment edge 335 it adapted to receive a second edge of the stopper 24 which is located opposite the first edge of the stopper with respect to a central portion of the stopper 24. This two-stair shape on the body 310 of the bracket 300 makes the bracket 300 adapted to receive the coupler 20 in the standard orientation, as shown in FIGS. 10A-10B, and further adapted to receive the coupler 20 in an orientation opposite the standard orientation, as shown in FIGS. 10C-10D.

Moreover, and in addition to the prior art bracket 100', the bracket 300 comprises a third concavity 350. The third concavity 350 should be of a shape substantially similar to the first concavity 320, or to the prior art first concavity 120' since the straight portion at an angle adapted for receiving the blocking bar 26 is not required for the third concavity 150. The third concavity 350 should be located approximately opposite the first concavity 320 with respect to the first concavity 320, and thus be located very close to the second concavity 340. According to an embodiment, the third concavity should be provided above the second concavity if the first abutment edge 330 and the second abutment edge 335 are also located above the central portion of the body 310, as shown in FIG. 10E.

By having a shape substantially similar to the first concavity 320, with an arc-of-circle shape conforms to a part of the cylindrical surface of the hinge shaft 22, the third concavity 350 can conform to a part of the cylindrical surface of the hinge shaft 22, which has a cylinder shape. This shape makes the third concavity 350 suitable to receive the hinge shaft 22 of the coupler 20 and thereby act as a hinge shaft receiver, as for the first concavity 320.

Contrarily to the first embodiment of the mounting bracket 100 where the third concavity 150 had an opening that was oriented outwardly, away from the central portion of the body 110, the third concavity 350 of the mounting bracket 300 has an opening directed inwardly, toward the first concavity 320. The orientation of both the third concavity 350 and the first concavity 320 are therefore very similar. The third concavity 350 of the mounting bracket 300 is therefore mirrored when compared to the third concavity 150 of the mounting bracket 100 (and this is the only element being mirrored since all other elements are arranged the same way as the first embodiment of the mounting bracket 100).

In addition to the second abutment edge 335 discussed above, this third concavity 350 makes the bracket 300 adapted to receive the coupler 20 in the standard orientation, as shown in FIGS. 10A-10B, and further adapted to receive the coupler 20 in an orientation opposite the standard orientation, as shown in FIG. 10C-10D.

The orientation opposite the standard orientation implies that the first concavity 320 receives the blocking bar 26, around which the bracket 300 does not hinge, contrarily to the hinge shaft 22. As discussed above, the first concavity 320 comprises a straight portion at an angle adapted for receiving the blocking bar 26.

This therefore makes the mounting bracket 300 adapted for reversible mounting orientation, in addition to the standard mounting orientation achieved in the prior art. Unlike the prior art bracket 100', for which only one standard orientation was possible with respect to the coupler 20 on the articulated arm, the mounting bracket 300 allows two different and opposite orientations as shown in FIGS. 10A-10B and 10C-10D. The first or standard orientation is provided by having the coupler 20 lock with the first concavity 320, the straight portion 342 of the second concavity 340, and the first abutment edge 330, which respectively cooperate with the hinge shaft 22, with the blocking bar 26, and with the stopper 24. The second or reversed orientation is provided by having the coupler 20 lock with the third concavity 350, the straight portion 322 of the first concavity 320, and the second abutment edge 335, which also respectively cooperate with the hinge shaft 22, with the blocking bar 26, and with the stopper 24. If a different orientation is required for scraping with the bucket or for a specific application using the bucket, the mounting bracket 300 can provide the required adaptability.

Combinations between the second and third embodiments can also be contemplated, such that the third concavity 250 of the mounting bracket 200 can be mirrored in a way similar to the third concavity 350 of the mounting bracket 300, thus being open inwardly instead of outwardly.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A bracket for reversibly mounting an excavation bucket on a coupler of an articulated arm, the bracket comprising:

a body extending in a plane, the body having a central portion and a hollow central portion formed by the central portion of the body;

a first concavity located on a first side of the body with respect to the central portion, the first concavity substantially having an arc-of-circle shape to receive and conform with a surface of a hinge shaft of the coupler in a first one of two reversible configurations and hinge therearound;

a second concavity on a second side of the body opposite the first side with respect to the central portion, for receiving a blocking bar of the coupler in the first one of two reversible configurations;

a third concavity on the second side of the body, the third concavity substantially having the arc-of-circle shape for receiving the hinge shaft of the coupler in a second one of the two reversible configurations thus allowing reversible mounting on the coupler, wherein the first concavity and the third concavity are each oriented to open outwardly from the central portion of the body, the hallow central portion of the body comprising: a first abutment edge which is flat and formed by the central portion of the body for receiving a stopper of the coupler in the first one of two reversible configurations; and a second abutment edge aside the first abutment edge and further from the central portion of the body compared to the first abutment edge, for receiving the stopper of the coupler in the second one of two reversible configurations, wherein the first abutment edge and the second abutment edge together form a two-stair shape on the body of the bracket in the hollow central portion to make the bracket adapted to receive the stopper of the coupler in any one of two reversible configurations.

2. The bracket of claim 1, wherein the first concavity ends with a straight portion for receiving the blocking bar of the coupler in the second one of the two reversible configurations.

3. The bracket of claim 2, wherein the third concavity is located above the second concavity on the second side of the body.

4. The bracket of claim 3, wherein the first abutment edge and the second abutment edge formed by the central portion of the body are located between the first concavity and the third concavity.

5. A bracket for mounting an excavation bucket on a coupler of an articulated arm, the bracket comprising:

a body extending in a plane and having a central portion and a hollow central portion formed by the central portion of the body;

a first concavity on a first side of the body with respect to the central portion, the first concavity substantially having an arc-of-circle shape to conform with a surface of a hinge shaft of the coupler in a first one of two reversible configurations and hinge therearound;

a second concavity on a second side of the body opposite the first side with respect to the central portion, for receiving a blocking bar of the coupler in the first one of two reversible configurations;

a third concavity on the second side of the body, the third concavity substantially having the arc-of-circle shape, for receiving the hinge shaft of the coupler in a second one of the two reversible configurations thus allowing reversible mounting on the coupler; and a fourth concavity on a first side of the body opposite the first side with respect to the central portion, for receiving a blocking bar of the coupler in the second one of two reversible configurations, wherein the first concavity and the third concavity are each oriented to open outwardly from the central portion of the body, the hollow central portion of the body comprising a first abutment edge and a second abutment edge, which are both flat and form symmetrically facing slopes, to make the bracket adapted for receiving a stopper of the coupler in any one of two reversible configurations and for holding the stopper firmly by abutting on one of the first abutment edge and the second abutment edge and for being held at a corner of the stopper by the other one of the first abutment edge and the second abutment edge.

6. The bracket of claim 5, wherein the fourth concavity is substantially the same shape as the second concavity, mirrored in the first side.

7. The bracket of claim 6, wherein the second concavity is located above the third concavity.

8. The bracket of claim 7, wherein the first concavity is located above the fourth concavity.

9. The bracket of claim 8, wherein the hollow central portion is substantially symmetrical.

10. The bracket of claim 9, wherein the hollow central portion comprises a recess and the recess is provided at a bottom thereof.

11. The bracket of claim 10, wherein the first abutment edge and the second abutment edge are provided on either sides of the recess provided at the bottom of the hollow central portion.

12. A bracket for reversibly mounting an excavation bucket on a coupler of an articulated arm, the bracket comprising:

a body extending in a plane and having a central portion;

a first concavity located on a first side of the body with respect to the central portion, the first concavity substantially having an arc-of-circle shape to receive and conform with a surface of a hinge shaft of the coupler in a first one of two reversible configurations and hinge therearound;

a second concavity on a second side of the body opposite the first side with respect to the central portion, for receiving a blocking bar of the coupler in the first one of two reversible configurations;

a third concavity on the second side of the body, the third concavity substantially having the arc-of-circle shape for receiving the hinge shaft of the coupler in a second one of the two reversible configurations thus allowing reversible mounting on the coupler, wherein the first concavity is oriented to open outwardly from the central portion of the body and the third concavity is oriented to open inwardly with respect to the central portion of the body.

13. The bracket of claim 12, further comprising:

a first abutment edge formed by the central portion of the body for receiving a stopper of the coupler in the first one of two reversible configurations; and a second abutment edge aside the first abutment edge and further from the central portion of the body compared to the first abutment edge, for receiving the stopper of the coupler in the second one of two reversible configurations.

14. The bracket of claim 13, wherein the first concavity ends with a straight portion for receiving the blocking bar of the coupler in the second one of the two reversible configurations.

15. The bracket of claim 14, wherein the third concavity is located above the second concavity on the second side of the body.

16. The bracket of claim 15, wherein the first abutment edge and the second abutment edge formed by the central portion of the body are located between the first concavity and the third concavity.

17. The bracket of claim 16, wherein the first abutment edge and the second abutment edge together form a two-stair shape on the body of the bracket to make the bracket adapted to receive the stopper of the coupler in any one of two reversible configurations.

* * * * *